US005123183A

United States Patent [19]

Paris et al.

[11] Patent Number: 5,123,183

[45] Date of Patent: Jun. 23, 1992

[54] REAR-ENTRY SKI BOOT

[75] Inventors: Jean Paris, Sevrier; Michel Mabboux, Seynod, both of France

[73] Assignee: Salomon S.A., Annecy Cedex, France

[21] Appl. No.: 505,470

[22] Filed: Apr. 6, 1990

[30] Foreign Application Priority Data

Apr. 7, 1989 [FR] France ..... 89 04616

[51] Int. Cl.[5] ..... A43B 5/04

[52] U.S. Cl. ..... 36/117; 36/120

[58] Field of Search ..... 36/117–121, 36/80, 97

[56] References Cited

U.S. PATENT DOCUMENTS

| | | | |
|---|---|---|---|
| 2,116,969 | 5/1938 | Cyr, Jr. | 36/117 |
| 2,131,283 | 9/1938 | Hubbard | 36/117 X |
| 2,449,294 | 9/1948 | Guindon | 36/117 X |
| 3,419,474 | 1/1969 | Lange | 36/119 X |
| 4,078,322 | 3/1978 | Dalebout | 36/80 X |
| 4,179,827 | 12/1979 | Vaccari | 36/80 X |
| 4,308,674 | 1/1982 | Tessaro | 36/118 |
| 4,551,993 | 11/1985 | Morell et al. | 36/120 |
| 4,587,747 | 5/1986 | Courvoisier et al. | 36/120 X |
| 4,959,914 | 10/1990 | Hilgarth | 36/119 |
| 4,982,515 | 1/1991 | Sartor | 36/117 |

FOREIGN PATENT DOCUMENTS

| | | | |
|---|---|---|---|
| 0252517 | 1/1988 | European Pat. Off. | 36/117 |
| 2619684 | 3/1989 | France | 36/117 |

*Primary Examiner*—Paul T. Sewell

*Attorney, Agent, or Firm*—Sandler, Greenblum & Bernstein

[57] ABSTRACT

A rear-entry ski boot having a lower shell above which an upper is mounted which includes a rear spoiler which is pivotally mounted on the lower shell to facilitate the insertion and removal of the skier's foot. The boot additionally includes a removable heel portion affixed in place by a connection on the extreme rear end of the sole of the boot. The lower shell of the boot is open rearwardly, i.e., the two sidewalls are not joined at the rear of the sole of the boot and the releasable heel portion extends upwardly by an upper curved part which acts as a seal with the concave side facing forwardly and the upper curved part to be applied on the rear opening of the lower shell that is bounded by the upper edges of its sidewalls by overlapping the skier's heel rearwardly and by providing continuity in the lower shell to the rear.

37 Claims, 6 Drawing Sheets

REAR-ENTRY SKI BOOT

BACKGROUND OF THE INVENTION

1. Field of the Invention

The present invention is directed to a rear-entry ski boot having a rearwardly pivoting spoiler for facilitating the insertion and removal of the skier's foot.

2. Description of Background and Other Information

7 Present-day alpine ski boots typically include a rigid or semi-rigid lower shell, and an upper which encloses the skier's lower leg. Usually, the upper consists of two elements, namely, a front cuff and a rear spoiler. The front cuff may be integral with the rigid lower shell and, in that case, only the rear spoiler is movable relative to the lower shell to allow the skier to put the boot on or to take it off. In other kinds of boots, the front cuff is also movably mounted on the lower shell about a horizontal and transverse pivot which may be the same as, or different from, the pivot axis of the rear spoiler.

Lastly, there are alpine ski boots of which the upper consists of a front cuff hinged on the lower shell and which comprises rearward extensions on which the hinge means of the rear spoiler is mounted. Accordingly, even though the rear spoiler is provided with a hinge means different from that of the cuff, it may nevertheless pivot about the same axis as the latter in the course of flexures from front to back and vice-versa. Moreover, some ski boots, such as described in U.S. Pat. No. 4,078,322, comprise an interchangeable heel portion which is affixed in a detachable manner to a lower projection, itself rigidly joined to the lower shell in the vicinity of the heel of the boot. This interchangeable heel portion is provided with a lower surface shaped so as to present projections improving the adhesion of the lower surface. As a result, when the lower surface is worn, it is easy to dispose of the worn heel portion and replace it with a new one.

With present-day alpine ski boots, the lower shell comprises a rear portion located beneath the rear spoiler and which rearwardly encloses the skier's heel. The rear part of the lower shell is integral with the rear portion and is especially hampering when it is desired to free the skier's foot from his or her boot following an accident. In the event of a bone fracture or a sprain, for example, of the skier's leg, the injured leg must be freed while, if at all possible, avoiding moving the foot, or at least minimizing such motion.

SUMMARY OF THE INVENTION

In view of the foregoing, it is an object of the present invention is to provide a removable heel portion for a ski boot for facilitating the removal of the skier's foot in the event of an emergency.

To this end, the ski boot of the present invention includes:

(a) a lower shell having an upwardly extending wall for receiving at least a portion of a foot, the upwardly extending wall being at least rearwardly open;

(b) an upper including a rear spoiler movably mounted relative to the lower shell; and (c) a member which is removably associated with the upwardly extending wall of the lower shell, the member including an upper wall for effectively closing the rearwardly open upwardly extending wall of the lower shell when the upper wall is associated with the upwardly extending wall of the lower shell.

In a particular aspect of the invention, the sole of the boot has a rearwardly extending portion and the removable member includes a lower portion which is removably affixed to the rearwardly extending portion of the sole.

Further according to this aspect of the invention, the rearwardly extending portion of the sole includes a lower surface, and the lower portion of the removable member covers at least a portion of the lower surface of the rearwardly extending portion of the sole.

In a preferred embodiment of the invention, a connection mechanism is provided for releasably connecting the lower portion of the removable member to the rearwardly extending portion of the sole.

Further according to a preferred embodiment of the invention, the rearwardly extending portion of the sole includes an outer peripheral portion, and the lower portion of the removable member further includes an interior recess for receiving the outer peripheral portion of the rearwardly extending portion of the sole.

Still further, the upper wall of the removable member includes portions which overlap respective portions of the upwardly extending wall.

In a particular embodiment of the invention, the rear spoiler is pivotally mounted relative to the upwardly extending wall of the lower shell.

In an additional embodiment of the invention, the rear spoiler is pivotally mounted upon the upper wall of the removable member.

According to a still further embodiment of the invention, the upper further includes a front cuff which is unitarily formed with the lower shell.

In an alternative embodiment of the invention, the upper further includes a front cuff and the rear spoiler is pivotally mounted upon the front cuff.

In a still further embodiment of the invention, the upper further includes a front cuff, and the rear spoiler is pivotally mounted upon the front cuff about a generally vertical axis.

In particular according to a specific embodiment of the invention, the rear spoiler is pivotally mounted about a first axis relative to the lower shell, and the upper further includes a front cuff which is pivotally mounted to the lower shell about a second axis.

In a particular embodiment of the invention, the first axis is positioned rearwardly of the upper wall of the removable member.

In a specific embodiment of the invention, the rear spoiler is pivotally mounted to the upper wall of the removable member.

According to a particular feature of the present invention, means are provided for guiding the removable member for forward translational movement and for rearward translational movement for affixing the removable member to the ski boot and for removing the removable member from the ski boot, respectively.

It is an additional object of the present invention to provide the removable heel member for use with a rear-entry ski boot for facilitating emergency removal of a foot from the ski boot, the removable heel member including an upper wall adapted to be positioned adjacent the heel of a foot and for maintaining the foot against rearward movement within the ski boot when the heel member is attached to the ski boot.

In a specific aspect of the invention, the upper wall is forwardly concave, with respect to the ski boot, the upper wall having lateral edges for being positioned adjacent respective lateral portions of the ski boot.

It is a further object of the present invention to provide a ski boot which facilitates the emergency removal of a foot therefrom, in which the boot includes:

(a) a sole having a heel part;

(b) a lower shell having a pair of spaced sidewalls defining a rear opening;

(c) an upper including a rear spoiler movably mounted relative to the lower shell and a front cuff; and (d) a heel portion which is removably associated with the sole, the heel portion including a curved upper wall effecting continuity of the lower shell across the rear opening and enclosing the heel of a skier's foot, the heel portion closing the rear opening of the lower shell.

According to a specific feature of the present invention, the removable heel portion is releasably affixed relative to the lower shell by a connection device located at least near the heel part of the sole.

According to an additional feature of the present invention, the curved upper wall of the removable heel portion includes a rear wall and a pair of forwardly extending sidewalls.

According to a still further feature of the present invention, the removable heel portion includes a lower part shaped so as to tightly nest onto the heel part of the sole.

In particular according to this feature of the present invention, the rear part of the sole includes side surfaces, the lower part of the removable heel portion includes a curved inner surface having a groove within which the side surfaces of the rear part of the sole are insertable in translation, and the removable heel portion further includes a lower wall which is adapted to be affixed beneath the rear part of the sole.

In another feature of the present invention, the rear spoiler is pivotally mounted to the cuff at a pivot zone, the upper includes a portion which overlaps the upper wall of the removable heel portion, and the removable heel portion is maintained against translation relative to the lower shell by means of the overlap portion of the upper on the upper wall of the removable heel portion, the overlap zone including the pivot zone.

In a particular embodiment of the present invention, the front cuff includes a pair of sidewalls having rearwardly extending ends, the rear spoiler is pivotally mounted about a first generally horizontal and transverse pivot axis on the rearwardly extending ends of the front cuff, the sidewalls of the front cuff being pivotally mounted on the lower shell about a second generally horizontal and transverse pivot, the curved upper wall of the removable heel portion includes a rear wall and a pair of side walls, the side walls of the removable heel portion extending within the rear spoiler, the rear wall of the removable heel portion having an upper end part which is adjacent to the first pivot axis, and which is external of the rear wall of the curved upper wall of the removable heel portion, and the sidewalls of the removable heel portion are positioned externally to the sidewalls of the lower shell and within the rearwardly extending ends of the front cuff.

In another embodiment of the present invention, the rear spoiler is pivotally mounted about a generally horizontal and transverse pivot axis upon the sidewalls of the lower shell, the sidewalls of the lower shell extend rearwardly to substantially the same extent as the sole, the sidewalls of the lower shell include a pair of respective rear edges which are generally located in a transverse plane at the rearwardmost end of the sole, the upper wall of the removable heel portion includes a rear wall having an upper edge, and the transverse pivot axis is positioned above the upper edge of the rear wall of the removable heel portion.

In a still further embodiment of the present invention, the upper wall of the removable heel portion includes a pair of sidewalls and a rear wall extending between and contiguous with the pair of sidewalls, the rear wall having an upper edge and a pivot receiving portion extending above the rear wall, the transverse pivot axis is positioned above the upper edge of the rear wall of the removable heel portion and extending through the pivot receiving portion of the removable heel portion, and the sidewalls of the upper wall of the removable heel portion are positioned exteriorly of the sidewalls of the lower shell.

In a still further aspect of the present invention, the front cuff is integral with the lower shell, the front cuff includes a rear edge, the rear spoiler is pivotally mounted to the front cuff about a generally vertical pivot axis extending along the rear edge of the front cuff between an open position and a closed position, the rear spoiler includes a lower part which overlaps at least a portion of the upper wall of the removable heel portion in the closed position of the rear spoiler, and the removable heel portion include a pair of front ends which are received within the sidewalls of the lower shell.

According to a particular aspect of the present invention, means are provided for affixing the removable heel portion to the heel part of the sole for maintaining the removable heel portion against translational movement relative to the heel part of the sole.

In one embodiment of this feature, the removable heel portion includes a lower wall having a hole therein, and the means for affixing the removable heel portion to the heel part of the sole includes a ¼ turn screw which passes through the hole in the lower wall of the removable heel portion and threaded into the heel part of the sole.

In another embodiment of this feature, the removable heel portion includes a lower wall having a hole therein, the heel part of the sole includes an opening, and the means for affixing the removable heel portion to the heel part of the sole includes a retractable locking mechanism including a stud and a spring positioned within the opening in the heel part of the sole which biases the stud to extend within the hole in the lower wall of the removable heel portion.

Further according to the present invention, the sole is formed unitarily with the lower shell.

Still further, the lower shell is comprised of a rigid, or semi-rigid material.

BRIEF DESCRIPTION OF THE DRAWING

The above and additional objects, characteristics, and advantages of the present invention will become apparent in the following detailed description of preferred embodiments, with reference to the accompanying drawing which is presented as non-limiting example, in which.

DETAILED DESCRIPTION OF PREFERRED EMBODIMENTS

Figure 1:
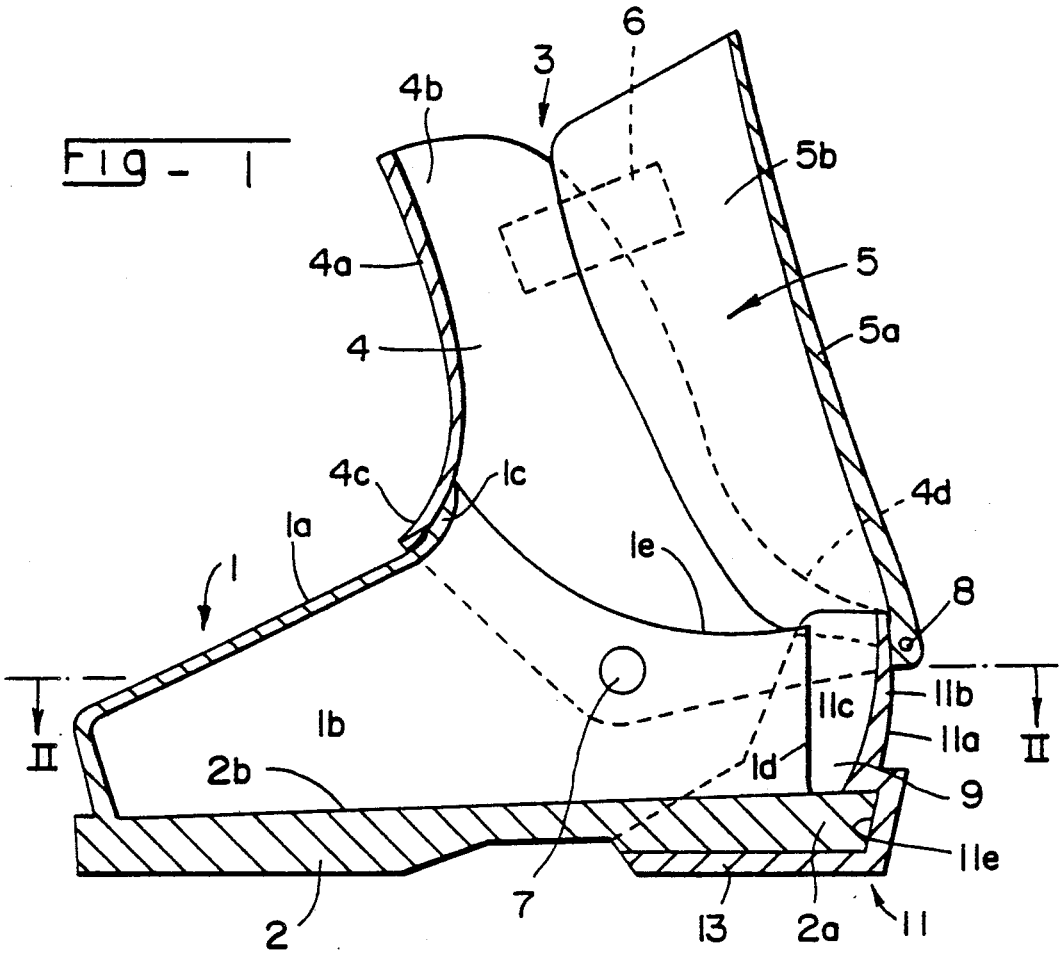
FIG. 1 is a vertical and longitudinal section of an alpine ski boot of the invention with a front cuff pivotally mounted on the lower shell and with the rear spoiler pivotally mounted on the front cuff, the boot being shown ready for skiing.

The present invention improves upon alpine ski boots presently known, and facilitates the removal of the ski boot and averts painful foot movement in the event of an accident and injury to the leg.

For this purpose, the alpine ski boot of the present invention comprises a lower shell, which can be rigid or semi-rigid, and above which lower shell there is an upper illustratively comprising a rear spoiler pivotally mounted relative to the lower shell of the boot to make it easier to insert or remove the boot, with a detachable heel portion being added and fixed in place, where called for, by assembly tools, on the rear end of the boot sole. In the boot of the present invention, each of the two sidewalls of the lower shell is interrupted near the heel by an area stretching from the upper edge of the lower shell to the sole vicinity, each of the areas thus defining a rear opening of the lower shell, the opening being sealed by the detachable heel portion above which rises a curved upper wall enclosing the skier's heel and providing the continuity toward the rear of the wall of the lower shell.

The alpine ski boot of the invention shown in FIGS. 1, 2 and 4, 5 comprises a rigid or semi-rigid lower shell advantageously made of plastic and including a forward upper wall 1*a* sloping from top to bottom and from rear to front, and of two vertical and lateral walls 1*b* merging into the sole 2 of the boot. From the lower shell 1, the upper 3 extends upwardly and which herein consists of two distinct components, namely, a front cuff 4 and a rear spoiler 5. In the course of skiing, the front cuff 4 and the rear spoiler 5 are tightened around the skier's lower leg by a suitable tightening means, schematically denoted by reference numeral 6 in FIG. 1. The front cuff 4 is hinged on the lower shell 1 about a lower transverse and horizontal axis embodied by two pivot elements 7, such as rivets, generally in transverse alignment. In orthogonal horizontal section, the front cuff 4 assumes the shape of a U, open at the rear. The cuff 4, furthermore, comprises two rearward sidewalls 4*b* and a front wall 4*a* stretching upwardly. The lower portions of the sidewalls 4*b* of the front cuff 4 extend outside the sidewalls 1*b* of the lower shell 1 to which they are adjacent, and they are connected to sidewalls 1*b* by the pivot elements 7 forming the transverse hinge axis of the cuff. Moreover, the lower edge 4*c* of the front wall 4*a* of the front cuff 4 and edge 1*c* of the sloping forward upper wall 1*a* of the lower shell 1 are shaped in such a way that they constitute a rear rest for the entire upper 3 when pivoting about the transverse axis 7. In particular, the lower edge 4*c* includes an inner projection coming to rest, when the upper 3 pivots clockwise about the axis 7, against the upper edge 1*c*, which in turn projects forwardly in order to keep back the upper as a whole.

In the embodiments shown in FIGS. 1, 2, 4, and 5, each sidewall 4*b* of the cuff 4 extends to the rear and at its lower part by a rear tip 4*d* at the back end of which hinges the rear spoiler 5. The spoiler 5 includes a rear wall 5*a* extending upwardly and forwardly by two sidewalls 5*b* positioned between the sidewalls 4*b* of the front cuff 4. The rear spoiler 5 thereby evinces a horizontal, essentially U-shaped cross-section which is open forwardly and it hinges about a horizontal and transverse pivot 8 at its lower end on two rear tips 4*d* of the front cuff 4.

Figure 2:
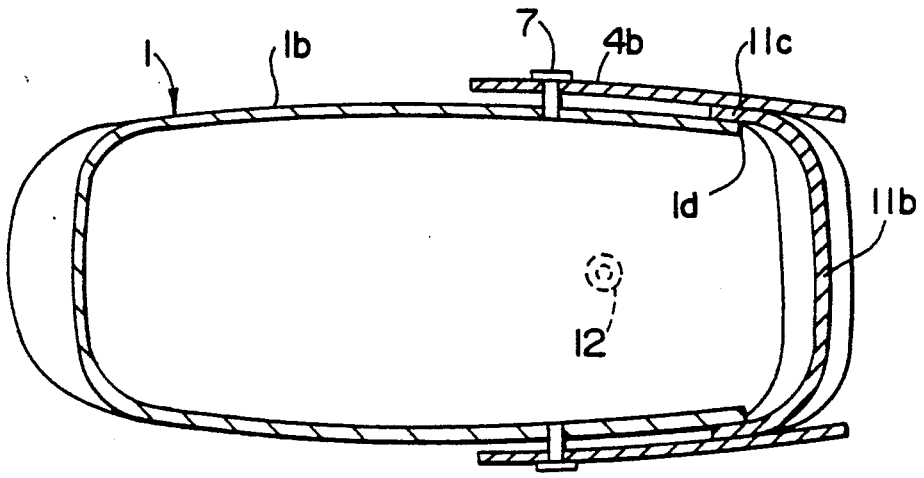
FIG. 2 is a horizontal section along line II—II of FIG. 1.

In the invention, the lower shell 1 is rearwardly open. In other words, the two sidewalls 1*b* do not join at the rear but, on the contrary, terminate some distance away from the rear end of the sole 2 by forming rear edges 1*d* extending from the upper edge 1*e* of the lower shell to the sole area 2*a*, terminating proximate the foot-supporting surface 2*b*. These edges 1*d* may be essentially vertical relative to the plane of the sole 2. Thereby, an opening 9 is formed at the rear of the lower shell 1. The opening 9 is sealed when the boot has been put on, as shown by FIGS. 1 and 2, by means of the upper part 11*a* of a removable heel portion 11 which in this case also constitutes the release portion. This seal-forming upper part 11*a* of the release portion 11 consists of a curved wall which is concave forwardly and which extends upwardly. The curved wall consists of a rear wall 11*b* and of two sidewalls 11*c* extending forwardly of the rear wall 11*b*.

Because of this design, whereby the rear spoiler is mounted on the extension of the rear tips 4*d* of the front cuff, the upper wall 11*a* of the removable heel portion 11 is within the enclosure of the lower rear part of the upper, whereby the heel portion 11 as a whole is maintained against translational movement by the lower shell with which it cooperates in the absence of any assembly means other than those of the upper 3 mounted on the lower shell.

Figure 12:
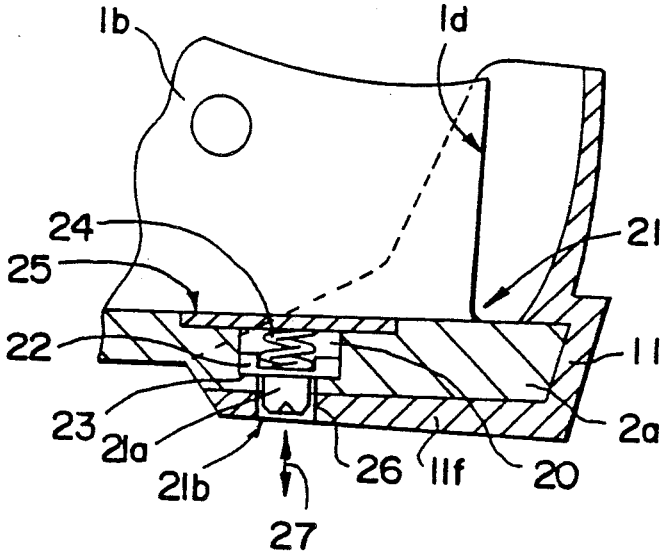
FIG. 12 is a longitudinal section of the sole heel zone, comprising means for locking the releasable heel portion on the lower shell using a retracting locking system.

The removable release portion 11 also includes a lower part 11*d* shaped in such a way that it snugly nests onto the rear part 2*a* of the sole 2, that is, onto the heel section of the boot. This lower part 11*d* advantageously is provided for that purpose with a curved groove 11*e* which receives projecting side 2*b* of the rear part 2*a* of the sole 2. The lower part 11*d* also comprises a lower horizontal wall 11*f* which moves beneath the rear part 2*a* of the sole 2 and which, where called for, may be provided with an inside surface equipped with projecting elements for adhesion to the rear part 2*a*. In order to improve the positional stability of the removable heel portion 11 on the lower shell, additional fastening means for the removable release portion may be provided on the rear part 2*a* of the sole 2 and may consist of various removable assembly means. Illustratively, such additional fastening may be provided by one or more screws 12 passing through holes 13 in the lower horizontal wall 11*f* of the removable portion 11 and threaded into the rear part 2*a* of the sole 2. In a preferred fastening mode, the removable release portion is fastened by at least one retracting locking means 21 such as shown in FIG. 12.

This variation of assembly can be applied to all kinds of rear-entry boots. Advantageously, such a heel portion locking-means requires no special tools to uncouple it from the boot in case of need. The bottom of the rear part 2*a* of the sole comprises a stepped cylindrical housing 20 completely passing through the sole. A shouldered stud 21*a* with a base 22 permanently resting because of the compressed spring 24 against the countersink 23 of the stepped hole is introduced into the stepped housing 20. The spring 24 is inserted between the upper part of the base 22 and a cover 25 blocking the stepped hole on the side of the sole where the foot rests. The cover is affixed of the rear part 2*a* of the sole while care is taken that its surface shall be flush with that of the sole, and it may further include sealing means.

Because of the action of the spring 24, the stud is constantly forced back outwardly and its lower end 21*b* is shaped so that the stub 11 can easily snap onto the sole portion 2*a*. For that purpose the heel portion 11 comprises a hole 26 matching the dimensions of the head 21*b* of the stud 21*a* housed in it when the heel portion is fully inserted into the sole portion 2*a*, thereby completing an assembly blocking any translation of the heel portion relative the shell. To free the releasable heel portion 11, the head 21*b* of the stud is pushed in the direction of arrow 27 to force it back on the sole so as to allow it to escape from the hole 26 and so to withdraw the heel portion 11 by horizontal translation. As shown in FIG. 12, the head 21*b* of the stud is preferably recessed to facilitate receipt of a projecting member for depressing the stud to effect release of the heel portion 11.

When the removable release portion 11 is affixed to the upper rear part 2*a* of the sole 2, in the manner shown in FIGS. 1 and 2, the upper part 11*a* of the heel portion 11 acting as a seal closes the rear of the opening 9 that was left free between the two upper edges 11*d* of the sidewalls 1*b* of the lower shell 1. The side surface of rear part 2*a* of the sole 2 tightly engages the groove 11*e* of the lower part 11*d* of the heel portion 11. The rear wall 11*b* and the sidewalls 11*c* of the seal 11*a* at their upper parts enter the lower part of the rear spoiler 5, the upper end part of the rear wall 11*b* being positioned near the pivot pin 8 of the rear spoiler 5 which is outside the wall 11*b*. Also, the sidewalls 1*c* of the seal 11*a* are engaged, outside the sidewalls 1*b* of the lower shell 1 which they slightly overlap, between the sidewalls 1*b* and the rear tips of the sidewalls 4*b* of the front cuff 4.

Figure 3:
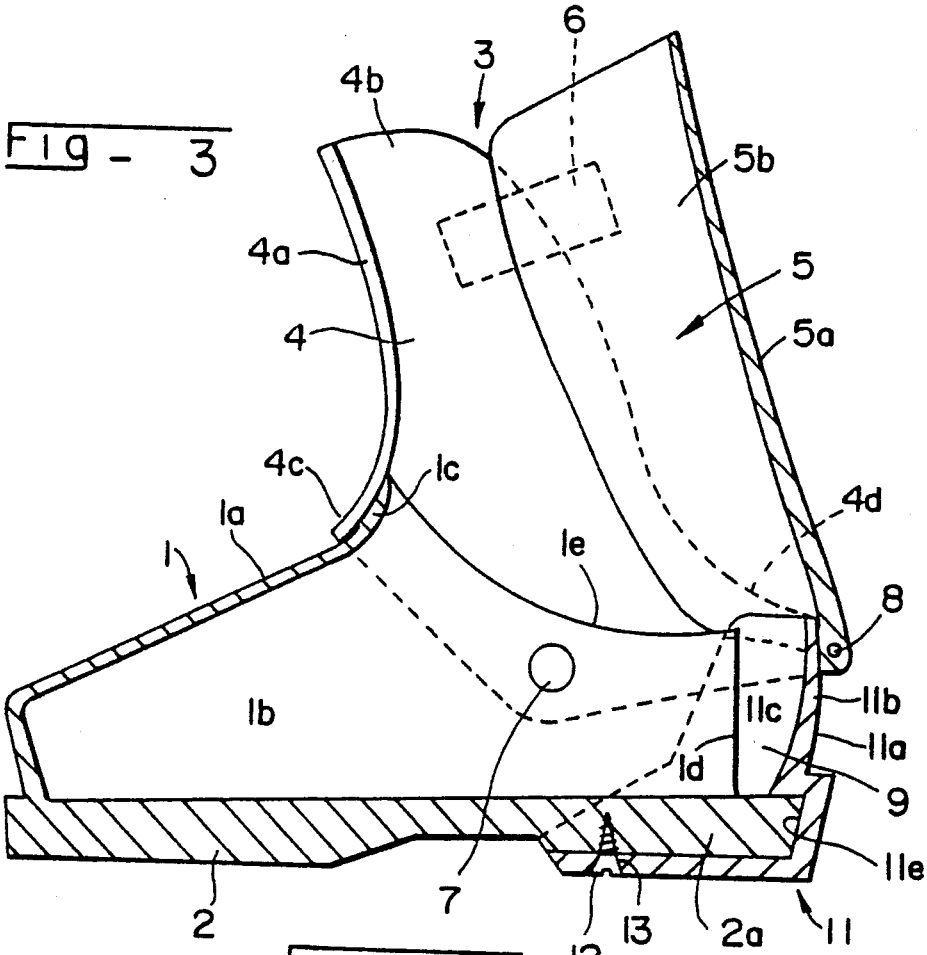
FIG. 3 is a longitudinal and vertical section of a boot of the invention similar to that of FIG. 1, but for which the releasable heel portion is equipped with additional assembly means near the sole.
Figure 4:
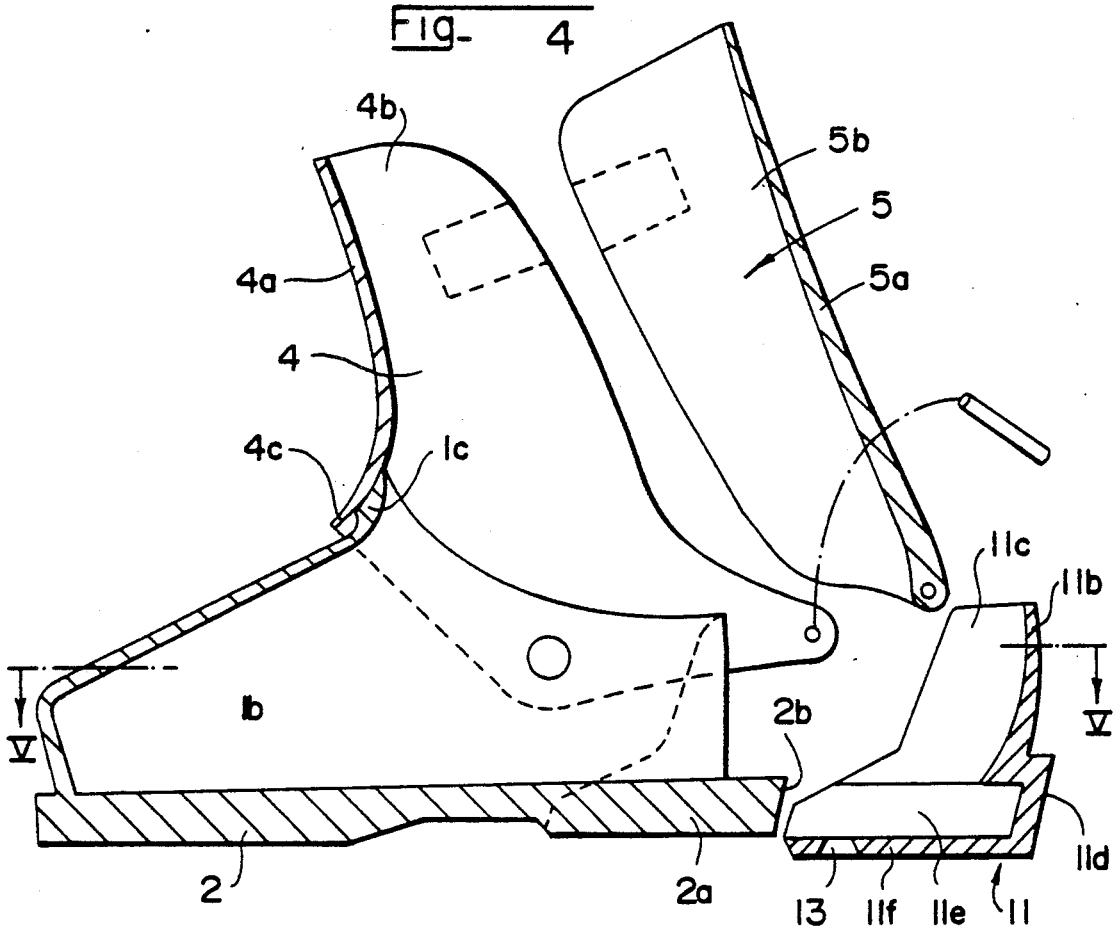
FIG. 4 is a longitudinal and vertical section of the alpine ski boot of FIG. 1, the rear spoiler and the removable releasable heel portion being shown removed from the remainder of the boot.
Figure 5:
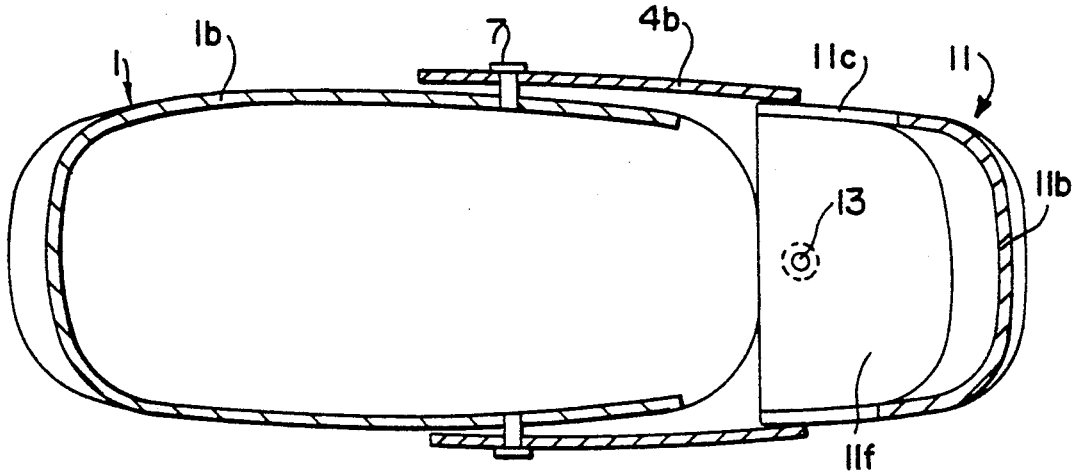
FIG. 5 is a horizontal section along line V—V of FIG. 4.

The aforementioned design much facilitates disassembling the rear part of the boot in an emergency when it is necessary to remove the boot from a skier's foot after an injury to the skier's leg or foot. In such an emergency, first the hinge pivot 8 is removed from the rear spoiler 5, and this is especially easy, with the pivot pin 8 being designed to be removable for that purpose. Once the rear spoiler 5 has been removed, the heel portion 11 is merely slid to the rear to remove it from that part of the sole 2*a*, as shown in FIGS. 4 and 5. In the event a boot as shown in FIG. 3 is involved, it will be necessary to remove the additional assembly means, i.e., the tightening screw or screws 12.

Advantageously, screw 12 is preferably of the ¼ turn type, i.e., which permits disengagement of the removable heel portion 11 from the sole part 2*a* in response to a quarter turn of the screw. Further, the screw preferably has a slotted head accepting a coin thickness in lieu of a screwdriver where not available.

Instead of the screws 12, the locking means illustrated in FIG. 12 and described above, for which access to head 21*b* of the stud 21 is easy, may be substituted. Once the stud 21 is depressed, no obstacle remains in the rearward direction for removing the skier's foot from the inside of the lower shell 1. Thus, the boot is easily removed without causing trauma to either the foot or leg of the skier.

Figure 6:
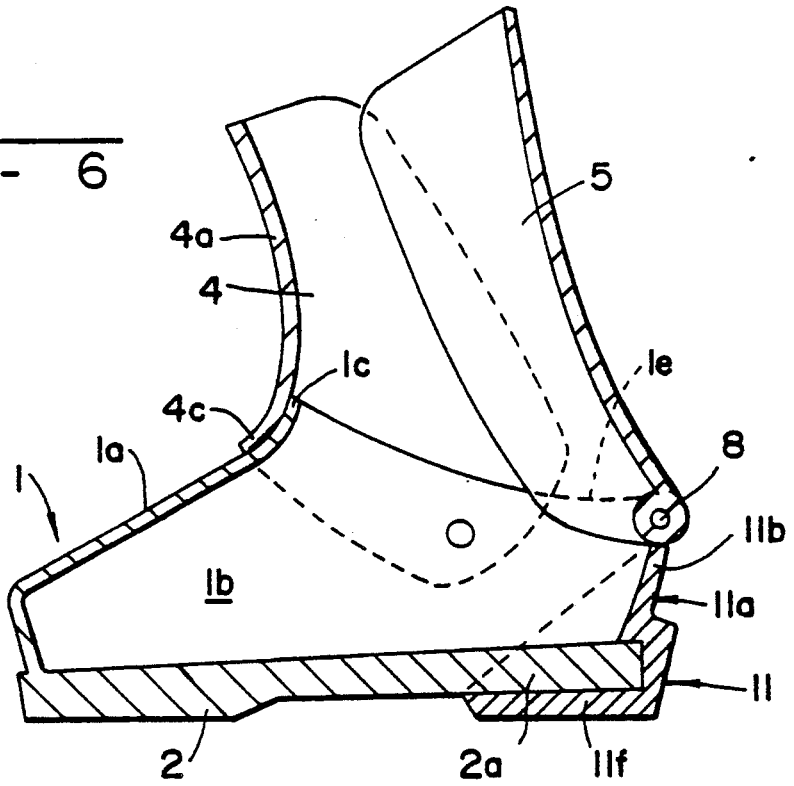
FIG. 6 is a vertical and longitudinal section of another embodiment of the alpine ski boot shown assembled, wherein the front cuff and the rear spoiler of the upper are pivotally mounted on the lower shell on separate individual pivots.
Figure 7:
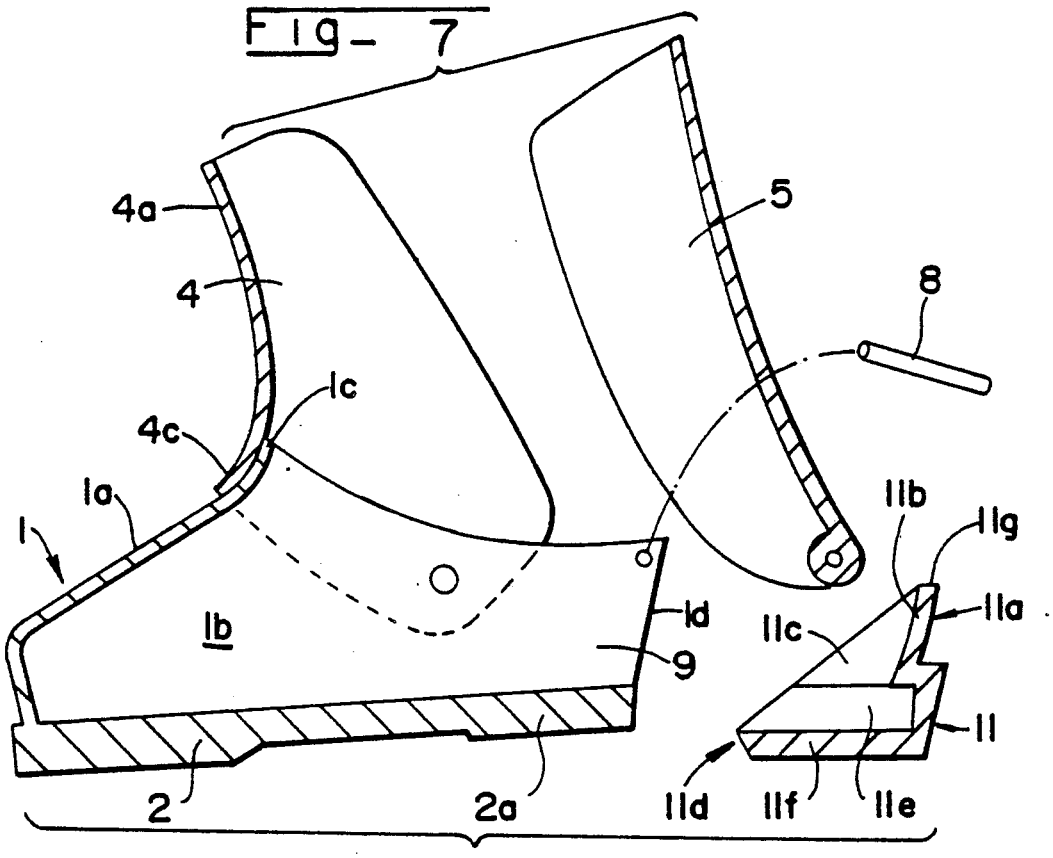
FIG. 7 is a vertical and longitudinal section of the boot shown in FIG. 6, the rear spoiler and the removable heel portion shown removed from the remainder of the boot.

In the variation of the invention shown in FIGS. 6 and 7, the sidewalls 1*b* of the lower shell 1 extend as far as the rear of the sole 2, however without joining. In this case, the rear edges 1*d* of the sidewalls 1*b* of the lower shell are, located essentially in a transverse plane which extends through the rear end of the sole 2, and the rear opening 9 of the lower shell also being located in this plane. The rear spoiler 5 hinges at its lower part about the pivot pin 8 directly on the rear parts of the sidewalls 1*b* of the lower shell 1. In this case, the transverse pivot pin 8 of the rear spoiler 5 is located just above the upper edge 11*g* of the rear wall 11*b* of the sealing part 11*a*. The rear rest for the upper 3 of the boot thus is implemented by the pivot pin 8 of the spoiler 5 being supported by the rear extensions 1*e* of the lower shell 1. Thereby, the lower edge 4*c* of the front wall 4 of the cuff 4 and the upper and rear edge 1*c* of the sloping front wall 1*a* of the lower shell 1 lack the projections acting as stops which were provided in the previously described embodiment relating to FIGS. 1 through 5.

In the embodiment shown in FIGS. 8 and 9, the boot again comprises the structure of an upper having two front and rear components separately pivotable on the lower shell. A particular feature of this embodiment of present invention is that the rear spoiler 5 directly pivots at upper edge 11*g* above the rear wall 11*a* of the heel portion 11, so that as soon as the connection means 12 or the retracting locking means 21 have been withdrawn from the sole, the assembly consisting of the heel portion 11 and the spoiler 5 can be removed from the remainder of the boot without the need to dismantle the pivot pin 8 mounted on the joint 11*h* above the rear wall 11*a*.

Figure 10:
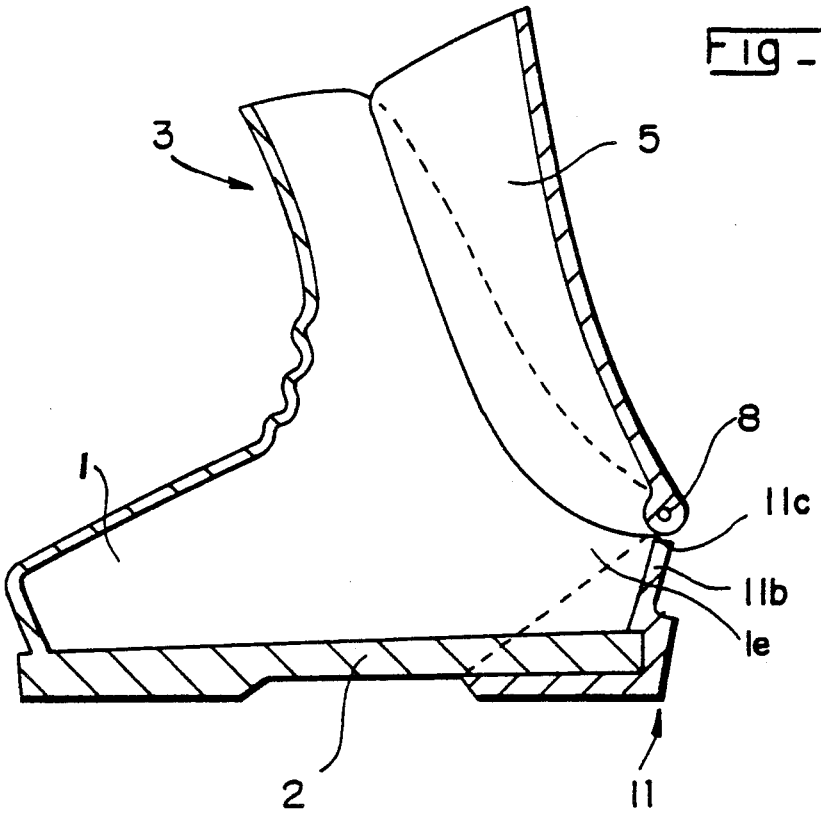
FIG. 10 is a vertical and longitudinal section of another embodiment of the alpine ski boot in which the front cuff is integral with the lower shell, and the rear spoiler alone hinges on the lower shell about a horizontal and transverse pivot.

In the embodiment shown in FIG. 10, the upper 3 of the boot comprises a front cuff 4 integral with the lower shell 1. In this embodiment again the rear spoiler 5 pivots about the horizontal and transverse pivot pin 8 on the rear extension 1*e* of the lower shell 1 in the manner of the embodiment of FIGS. 6 and 7, and its lower part is located above the upper edge 11*c* of the rear wall 11*b* of the release portion 11.

Figure 8:
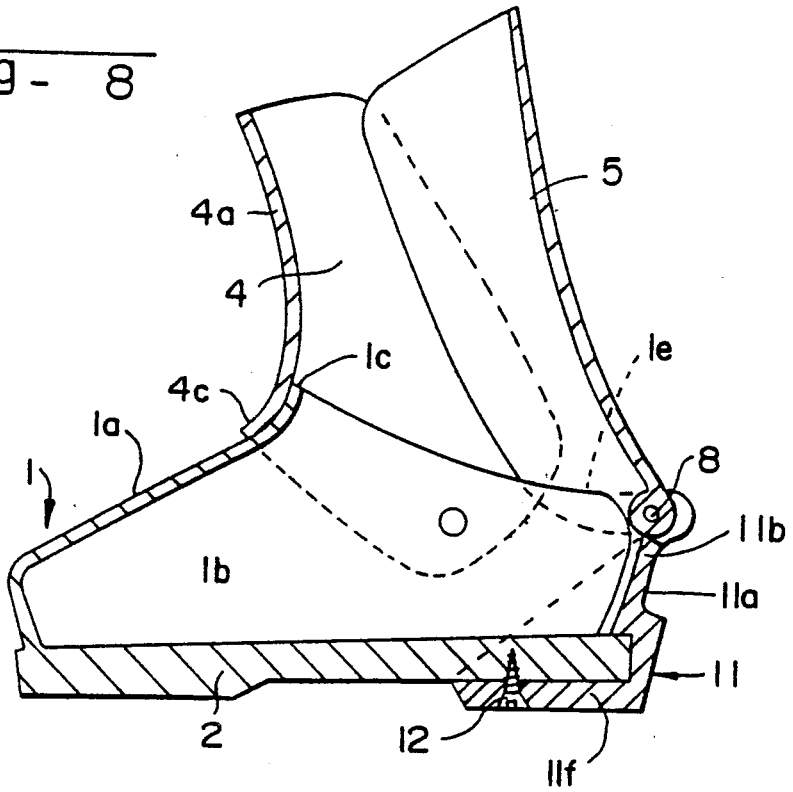
FIGS. 8 and 9 show a boot of the invention similar to that of FIGS. 6 and 7 but for which the rear spoiler is pivotally mounted directly on the upper wall of the releasable heel portion.
Figure 9:
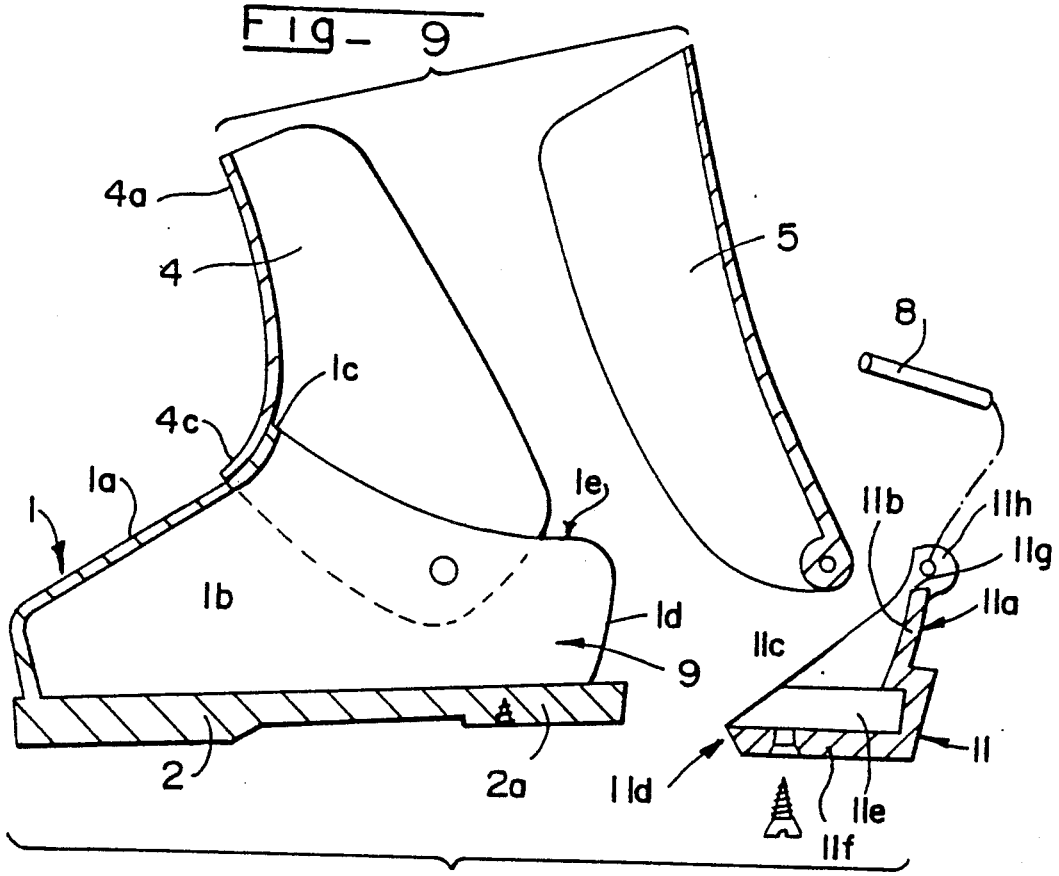
Figure 11:
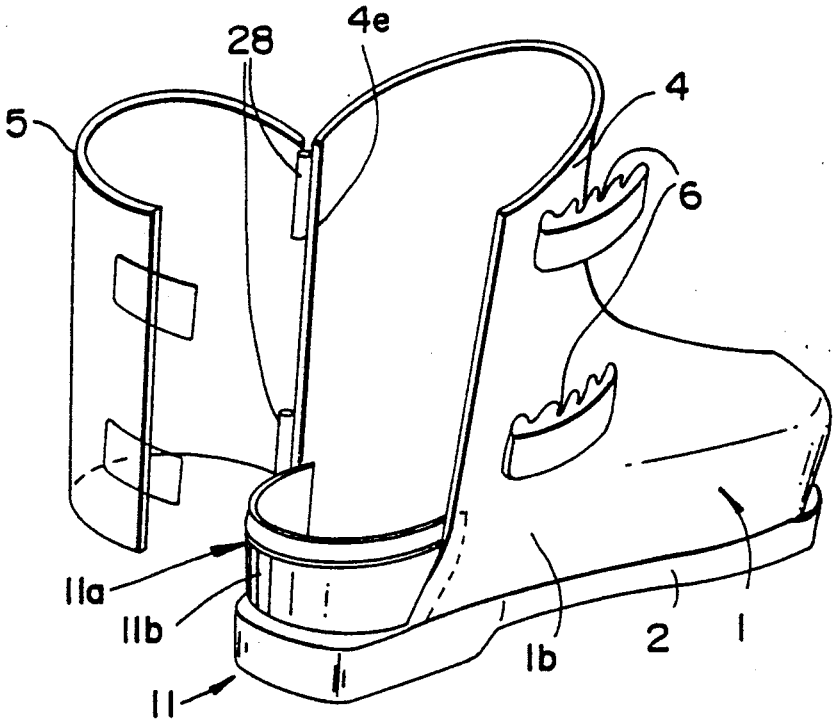
FIG. 11 is a perspective of a variation of the alpine ski boot of FIG. 10, comprising a rear spoiler pivotally mounted about a lateral and generally vertical axis.

FIG. 11 illustrates an embodiment of the alpine ski boot shown in FIG. 7, which comprises a front cuff 4 integral with the lower shell 1. In this instance, however, the rear spoiler 5 is hinged along a rear edge 4*e* of the front cuff 4, this edge being essentially vertical. In this case, the pivot 28 of the rear spoiler 5 consists of one or more hinges linking the front edge of the spoiler 5 to the rear edge 4*a* of the front cuff 4 and is located sideways and assumes an essentially vertical position. Because of this design, the rear spoiler 5 by its lower part covers the upper part 11*a* acting as the seal for the release portion 11 when the rear spoiler 5 is closed. In this case, the upper of the boot consists of the front cuff 4 and the rear spoiler 5, which are kept tightly clamped against each other by the clamping means 6, and completely encloses the skier's lower leg. As shown by FIG. 8, the front ends of the upper wall 11*b* of the release portion 11 in normal operation slightly enter the rear parts of the sidewalls 11*b* of the lower shell 1.

Although the invention has been described with reference of particular means, materials and embodiments, it is to be understood that the invention is not limited to the particulars disclosed and extends to all equivalents within the scope of the claims.

What is claimed is:

1. A ski boot comprising:

(a) a sole having a heel part;

(b) a lower shell having a pair of spaced sidewalls defining a rear opening;

(c) an upper comprising a rear spoiler movably mounted relative to said lower shell and a front cuff; and (d) a heel portion, means for removably associating said heel portion with said sole, said heel portion comprising a curved upper wall effecting continuity of said lower shell across said rear opening and enclosing the heel of a skier's foot, said heel portion closing said rear opening of said lower shell.

2. A ski boot according to claim wherein said removable heel portion is releasably affixed relative to said lower shell by a connection device located at least near said heel part of said sole.

3. A ski boot according to claim 1, wherein said curved upper wall of said removable heel portion comprises a rear wall and a pair of forwardly extending sidewalls.

4. A ski boot according to claim 1, wherein said removable heel portion comprises a lower part shaped so as to tightly nest onto said heel part of said sole.

5. A ski boot according to claim 2, wherein said removable heel portion comprises a lower part shaped so as to tightly nest onto said heel part of said sole.

6. A ski boot according to claim 3, wherein said removable heel portion comprises a lower part shaped so as to tightly nest onto said heel part of said sole.

7. A ski boot according to claim 4, wherein said rear part of said sole comprises side surfaces, wherein said lower part of said removable heel portion includes a curved inner surface having a groove within which said side surfaces of said rear part of said sole are insertable, and wherein said removable heel portion further comprises a lower wall which is adapted to be affixed beneath said rear part of said sole.

8. A ski boot according to claim 5, wherein said rear part of said sole comprises side surfaces, wherein said lower part of said removable heel portion includes a curved inner surface having a groove within which said side surfaces of said rear part of said sole are insertable, and wherein said removable heel portion further comprises a lower wall which is adapted to be affixed beneath said rear part of said sole.

9. A ski boot according to claim 6, wherein said rear part of said sole comprises side surfaces, wherein said lower part of said removable heel portion includes a curved inner surface having a groove within which said side surfaces of said rear part of said sole are insertable, and wherein said removable heel portion further comprises a lower wall which is adapted to be affixed beneath said rear part of said sole.

10. A ski boot according to claim 1, wherein said rear spoiler is pivotally mounted to said cuff at a pivot zone, wherein said upper comprises a portion which overlaps said upper wall of said removable heel portion, wherein said removable heel portion is maintained against translation relative to said lower shell by means of said overlap portion of said upper on said upper wall of said removable heel portion, said overlap zone including said pivot zone.

11. A ski boot according to claim 1, wherein said front cuff comprises a pair of sidewalls having rearwardly extending ends, wherein said rear spoiler is pivotally mounted about a first generally horizontal and transverse pivot axis on said rearwardly extending ends of said front cuff, said sidewalls of said front cuff being pivotally mounted on said lower shell about a second generally horizontal and transverse pivot, wherein said curved upper wall of said removable heel portion comprises a rear wall and a pair of side walls, said side walls of said removable heel portion extending within said rear spoiler, said rear wall of said removable heel portion having an upper end part which is adjacent to said first pivot axis, and which is external of said rear wall of said curved upper wall of said removable heel portion, wherein said sidewalls of said removable heel portion being positioned externally to said sidewalls of said lower shell and within said rearwardly, extending ends of said front cuff.

12. A ski boot according to claim 1, wherein said rear spoiler is pivotally mounted about a generally horizontal and transverse pivot axis upon said sidewalls of said lower shell, wherein said sidewalls of said lower shell extend rearwardly to substantially the same extent as said sole, wherein said sidewalls of said lower shell comprise a pair of respective rear edges which are generally located in a transverse plane at the rearwardmost end of said sole, wherein said upper wall of said removable heel portion comprises a rear wall having an upper edge, and wherein said transverse pivot axis is positioned above said upper edge of said rear wall of said removable heel portion.

13. A ski boot according to claim 1, wherein said upper wall of said removable heel portion comprises a pair of sidewalls and a rear wall extending between and contiguous with said pair of sidewalls, said rear wall having an upper edge and a pivot receiving portion extending above said rear wall, wherein said transverse pivot axis is positioned above said upper edge of said rear wall of said removable heel portion and extending through said pivot receiving portion of said removable heel portion, and wherein said sidewalls of said upper wall of said removable heel portion are positioned exteriorly of said sidewalls of said lower shell.

14. A ski boot according to claim 1, wherein said front cuff is integral with said lower shell, wherein said front cuff comprises a rear edge, wherein said rear spoiler is pivotally mounted to said front cuff about a generally vertical pivot axis extending along said rear edge of said front cuff between an open position and a closed position, wherein said rear spoiler comprises a lower part which overlaps at least a portion of said upper wall of said removable heel portion in said closed position of said rear spoiler, and wherein said removable heel portion comprise a pair of front ends which are received within said sidewalls of said lower shell.

15. A ski boot according to claim 1, further comprising means for affixing said removable heel portion to said heel part of said sole for maintaining said removable heel portion against translational movement relative to said heel part of said sole.

16. A ski boot according to claim 15, wherein said removable heel portion comprises a lower wall having a hole therein, wherein said means for affixing said removable heel portion to said heel part of said sole comprises a ¼ turn screw which passes through said hole in said lower wall of said removable heel portion and threaded into said heel part of said sole.

17. A ski boot according to claim 15, wherein said removable heel portion comprises a lower wall having a hole therein, wherein said heel part of said sole comprises an opening, wherein said means for affixing said removable heel portion to said heel part of said sole comprises a retractable locking mechanism comprising a stud and a spring positioned within said opening in said heel part of said sole which biases said stud to extend within said hole in said lower wall of said removable heel portion.

18. A ski boot according to claim 1, wherein said sole is formed unitarily with said lower shell.

19. A ski boot according to claim 1, wherein said lower shell is comprised of a rigid material.

20. A ski boot according to claim 1, wherein said lower shell is comprised of a semi-rigid material.

21. A ski boot comprising:

(a) a lower shell having an upwardly extending wall for receiving at least a portion of a foot, said upwardly extending wall having a rear opening;

(b) an upper comprising a rear spoiler movably mounted relative to said lower shell;

(c) a foot-supporting surface within said lower shell, said rear opening of said lower shell extending to an area proximate said foot-supporting surface, said upwardly extending wall of said lower shell not substantially opposing rearward movement of the foot; and (d) a member which is removably associated with said upwardly extending wall of said lower shell, said member comprising an upper wall for effectively closing said rear opening of said lower shell when said upper wall is associated with said upwardly extending wall of said lower shell.

22. A ski boot according to claim 21, further comprising a sole for supporting the foot, said sole having a rearwardly extending portion, wherein said removable member comprises a lower portion which is removably affixed to said rearwardly extending portion of said sole.

23. A ski boot according to claim 22, wherein said rearwardly extending portion of said sole comprises a lower surface, and wherein said lower portion of said removable member covers at least a portion of said lower surface of said rearwardly extending portion of said sole.

24. A ski boot according to claim 23, further comprising a connection mechanism for releasably connecting said lower portion of said removable member to said rearwardly extending portion of said sole.

25. A ski boot according to claim 22, wherein said rearwardly extending portion of said sole comprises an outer peripheral portion, and wherein said lower portion of said removable member further comprises an interior recess for receiving said outer peripheral portion of said rearwardly extending portion of said sole.

26. A ski boot according to claim 20, wherein said upper wall of said removable member includes portions which overlap respective portions of said upwardly extending wall.

27. A ski boot according to claim 20, wherein said rear spoiler is pivotally mounted relative to said upwardly extending wall of said lower shell.

28. A ski boot according to claim 20, wherein said rear spoiler is pivotally mounted upon said upper wall of said removable member.

29. A ski boot according to claim 20, Wherein said upper further comprises a front cuff which is unitarily formed with said lower shell.

30. A ski boot according to claim 20, wherein said upper further comprises a front cuff and wherein said rear spoiler is pivotally mounted upon said front cuff.

31. A ski boot according to claim 20, wherein said upper further comprises a front cuff, and wherein said rear spoiler is pivotally mounted upon said front cuff about a generally vertical axis.

32. A ski boot according to claim 20, wherein said rear spoiler is pivotally mounted about a first axis relative to said lower shell, and wherein said upper further comprises a front cuff which is pivotally mounted to said lower shell about a second axis.

33. A ski boot according to claim 31, wherein said rear spoiler is pivotally mounted upon said front cuff.

34. A ski boot according to claim 32, wherein said first axis is positioned rearwardly of said upper wall of said removable member.

35. A ski boot according to claim 31, wherein said rear spoiler is pivotally mounted to said upper wall of said removable member.

36. A ski boot according to claim 20, further comprising means for guiding said removable member for forward translational movement and for rearward translational movement for affixing said removable member to said ski boot and for removing said removable member from said ski boot, respectively.

37. A ski boot comprising:

an outer shell having a rear opening and a removable heel member facilitating emergency removal of a foot from said ski boot, said removable heel member comprising an upper wall adapted to be positioned adjacent the heel of a foot, at least a portion of said upper wall of said removable heel member having a shape to be generally continuous with said outer shell of said ski boot, and said upper wall of said removable heel member maintaining the foot against rearward movement within said ski boot when said heel member is attached to said ski boot, wherein said ski boot further comprises a lower shell having an upwardly extending wall for receiving at least a portion of the foot, said upwardly extending wall being at least rearwardly open, an upper comprising a rear spoiler movably mounted relative to said lower shell, and wherein said upper wall of said removable heel member effectively closes said rearwardly open upwardly extending wall of said lower shell when said upper wall is associated with said upwardly extending wall of said lower shell.

* * * * *